United States Patent [19]

D'Annunzio

[11] Patent Number: 4,789,156

[45] Date of Patent: Dec. 6, 1988

[54] PORTABLE BASKETBALL GOAL

[76] Inventor: Ray D'Annunzio, 1457 North Rd., Howland, Ohio 44484

[21] Appl. No.: 100,612

[22] Filed: Sep. 24, 1987

[51] Int. Cl.[4] ..... A63B 63/08

[52] U.S. Cl. ..... 273/1.5 R; 280/727; 293/117

[58] Field of Search ..... 273/1.5 R, 1.5 A, 411; 280/769, 727, 289 R, 762; 293/117

[56] References Cited

U.S. PATENT DOCUMENTS 2,227,310 12/1940 Hoppes et al. ..... 273/1.5 R
3,427,025 2/1969 Procter ..... 273/1.5 R
3,953,029 4/1976 Boyd ..... 273/411 X
4,526,367 7/1985 Haston et al. ..... 273/1.5 R

FOREIGN PATENT DOCUMENTS 89614 9/1983 European Pat. Off. ..... 293/117

OTHER PUBLICATIONS

The Evening Star 8/6/1968, Fun Wagon.

*Primary Examiner*—Paul E. Shapiro
*Attorney, Agent, or Firm*—Harpman & Harpman

[57] ABSTRACT

A portable basketball goal for use on a pick-up truck has a adjustable frame assembly that is inner-connected to and stabilized by a pick-up truck. The portable basketball goal can be dis-assembled into modular units and easily transported within the truck.

3 Claims, 2 Drawing Sheets

PORTABLE BASKETBALL GOAL

BACKGROUND OF THE INVENTION

1. Technical Field:

This invention relates to portable basketball goals and supports that position and hold a basketball hoop and net at the desired distance from the ground.

2. Description of Prior Art:

Prior Art devices of this type have relied on a variety of self-contained self-supporting portable frame structures, see for example U.S. Pat. No. 2,227,310, U.S. Pat. No. 3,427,025 and U.S. Pat. No. 4,526,367.

In U.S. Pat. No. 2,227,310 a folding basketball back stop is shown having an upright frame with a movable backboard and adjustable players pad.

U.S. Pat. No. 3,427,025 discloses a vertically adjustable basketball goal that has a triangular frame base with a braced adjustable vertically aligned pole from which is positioned a basketball backboard and basket. The base has wheels to provide for mobility of the unit.

U.S. Pat. No. 4,526,367 discloses a portable basketball goal having a vertically adjustable backboard and basket sideably positioned on a portable frame.

SUMMARY OF THE INVENTION

A portable basketball goal that is used in connection with a pick-up truck that acts as an adjustable support member in conjunction with the device. The portable basketball goal has a two-piece vertically aligned frame supports that are inner-connected by an adjustable linking member.

DESCRIPTION OF THE PREFERRED EMBODIMENT

Figure 1:
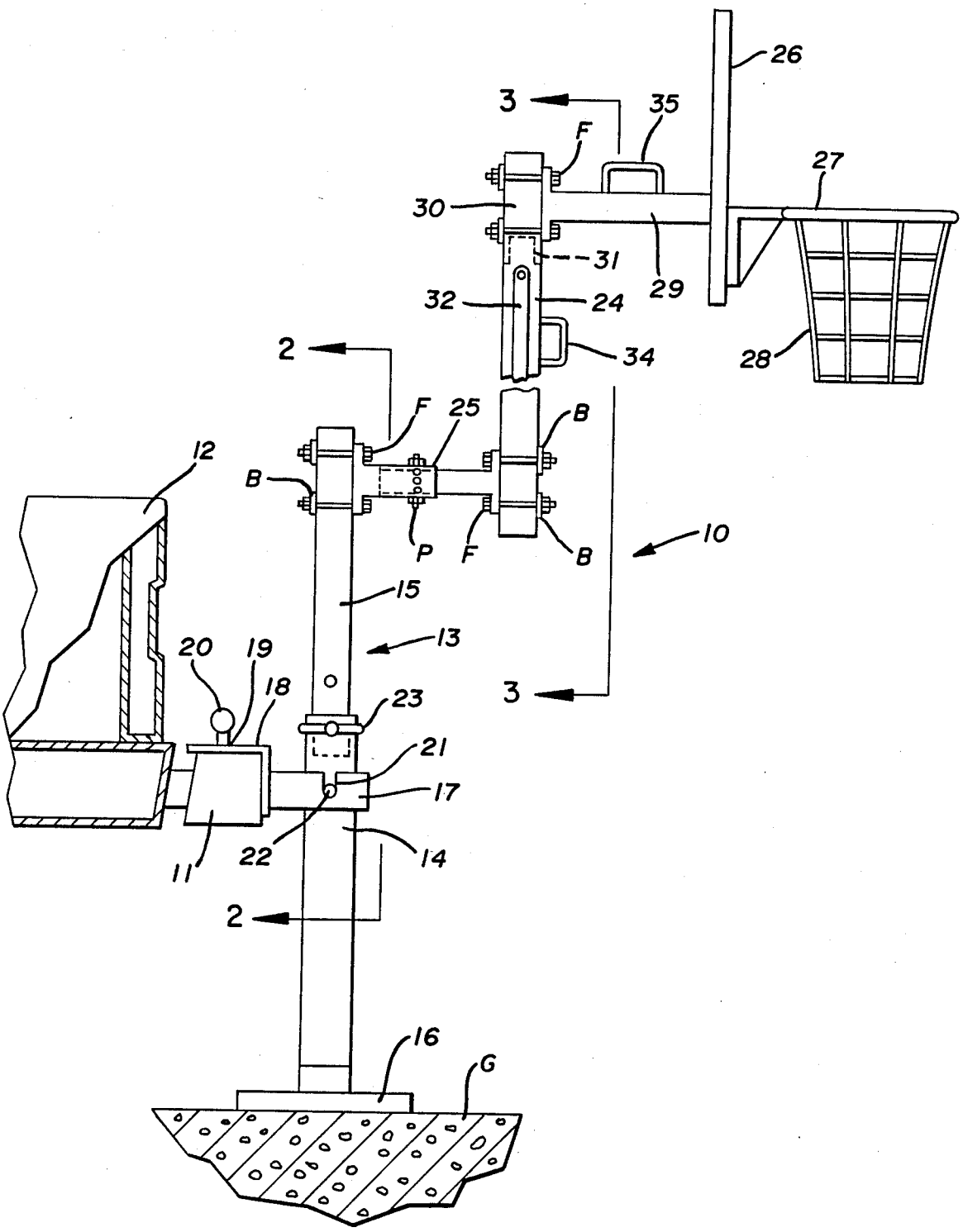
FIG. 1 is a side plan view of the basketball goal fully extended secured to a pick-up truck.
Figure 3:
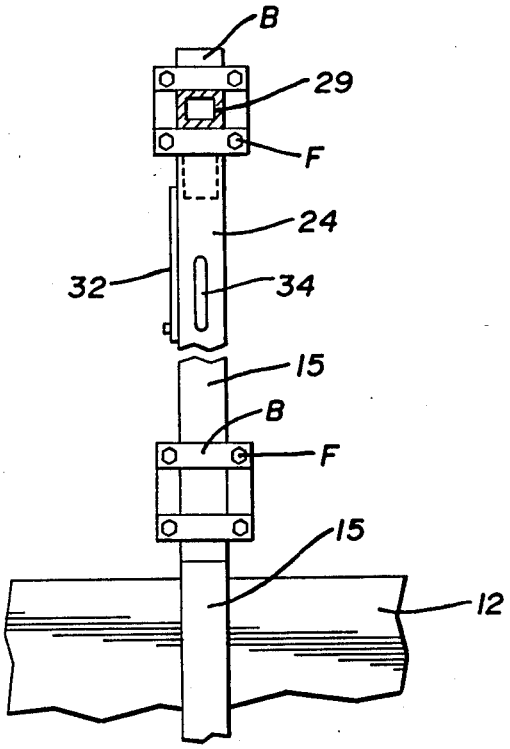
FIG. 3 is a front plan view on lines 3—3 of FIG. 1.
Figure 2:
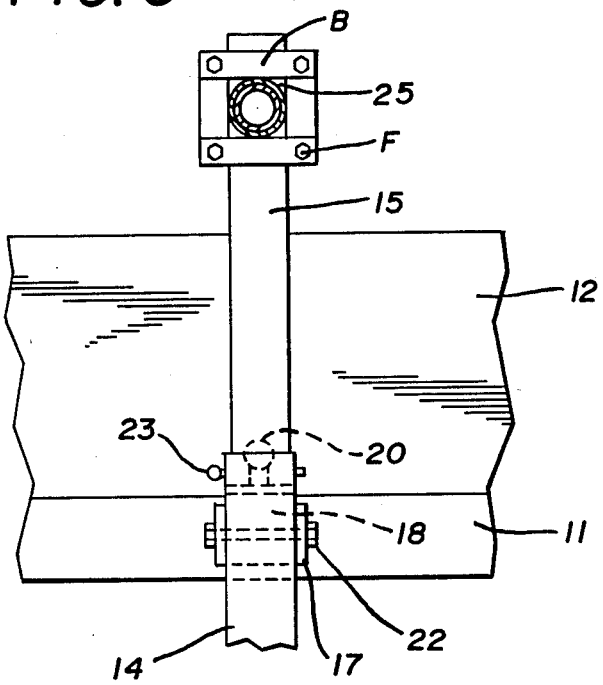
FIG. 2 is a front plan view on lines 2—2 of FIG. 1.
Figure 5:
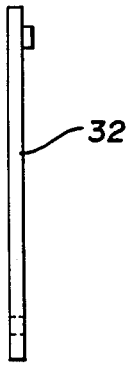
FIG. 5 is an enlarged side plan view of a locking arm seen in FIG. 4.

Referring to FIGS. 1, 2 and 3 of the drawings, a basketball goal 10 is shown secured to a truck bumper 11 of a pick-up truck 12. The portable basketball goal is comprised of a main tubular support frame 13 having a ground engaging portion 14 and a upper support portion 15 that is telescopically disposed within said ground engaging portion 14. A base support 16 is positioned on the free end of the ground engaging portion 14 to provide a wide stable support.

A bifurcated stabilization bracket 17 extends from a vertical offset bumper support 18 that is apertured at 19 to be secured onto the truck bumper 11 by a trailer hitch 20. The stabilizing bracket 17 has oppositely disposed vertically aligned elongated u-shaped apertures at 21 which are engageable on a boss 22 on the ground engageable portion 14 of the tubular support frame 13. A T bolt 23 extends through aligned apertures in the ground engaging and upper support portions 14 and 15 respectively interlocking same together.

A second tubular support frame 24 extends vertically from a two part adjustable support frame inner-connector 25 secured to both the upper support portion 15 and the secondary tubular support frame 24 by multiple fasteners F and apertured brackets B secured thereon. Each part of the adjustable support frame inner-connector opposite said fasteners F inter-engage one another having a plurality of spaced arcuately aligned apertures with an engagement pin P positioned therethrough. This arrangement allows for the multiple angular adjustment between the main support frame 13 and the secondary tubular support frame 24 which will be discussed in greater detail later.

A basketball backboard 26 has an attached hoop 27 and net 28 extending therefrom and is positioned on one end of a backboard support arm 29. The other end of the backboard support arm 29 is secured to a vertically aligned tubular fitting 30 by fasteners F that is inserted over the upper end of the secondary support frame 24 which has an area of reduced outer diameter 31.

Figure 4:
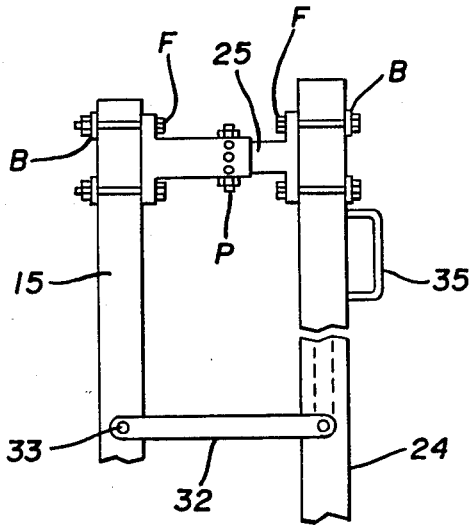
FIG. 4 is a side plan view of a portion of the basketball goal in collapsed transportatable position.

A storage and transport arm 32 is pivotally secured to the secondary tubular support arm 24 and can be extended to be engaged by a pin thereon in an aperture on the main tubular support frame 13 at 33, best seen in FIG. 4 of the drawings. The engagement of the storage and transport arm 32 is possible when the tubular fitting 30 is disengaged and the frame inner-connector 25 is rotated, moving the secondary tubular support arm 24 180° to a transport and storage position. It will be evident from the above description that the portable basketball goal can be adjusted to different ground conditions so as to always align the backboard and basket vertically and horizontally regardless of the relative position of the truck 12 and the ground G by moving the base 16 and rotation of the inner-connector 25 as hereinbefore described.

To dis-assemble the portable basketball goal, the T pin 23 is removed allowing the upper support portion 15 to move downwardly into the ground engaging portion 14. The tubular fitting 30 with its attached backboard support arm 29 is removed and the inner-connector 25 is rotated. The entire assembly is lifted up off the boss 22. A handle 34 on the secondary tubular support frame 24 is used to move the assembly for storage and transport. A handle 35 on the backboard support arm 29 is used to move the backboard and attached rim and net independently of the main assembly.

Thus, it will be seen that a new and completely portable basketball goal has been illustrated and described and it will apparent to those skilled in the art that changes and modifications may be made therein without departing from the spirit of the invention, therefore I claim:

1. A portable basketball goal used with a pick-up truck having a bumper comprises a main support frame and a secondary support frame, said main support frame having two interdependent portions, means for adjustably securing one of said portions to said pick-up truck, a multiple part support frame inner-connector between said support frames, a basketball goal and backboard assembly removably secured to said secondary support frame, means for rotating said secondary support frame in relation to said main support frame, a ground engaging base support movably secured to one end of said inner-dependent portions of said main support frame.

2. The portable basketball goal of claim 1 wherein said means for adjustably securing one of said portions to the pick-up truck comprises an offset bumper support removably secured to said bumper and a bifurcated stabilization bracket extending from said bumper support engageable on said main support frame.

3. The portable basketball goal of claim 1 wherein said means for rotating said secondary support frame comprises said support frame inner-connector having two adjustable parts engaging one another with a plurality of spaced aligned apertures within each respectively registerable by an engagement pin.

* * * * *